United States Patent [19]

Williams et al.

[11] 4,204,201

[45] May 20, 1980

[54] MODULAR ALARM SYSTEM

[75] Inventors: Stewart J. Williams, Orinda; Shailer T. Pickton, Lafayette, both of Calif.

[73] Assignee: Systron Donner Corporation, Concord, Calif.

[21] Appl. No.: 970,922

[22] Filed: Dec. 19, 1978

[51] Int. Cl.[2] ..... G08B 19/00

[52] U.S. Cl. ..... 340/521; 340/517

[58] Field of Search ..... 340/500, 517, 521, 506, 340/52 F

[56] References Cited

U.S. PATENT DOCUMENTS

| | | | |
|---|---|---|---|
| 3,990,075 | 11/1976 | Schmitz et al. | 340/521 |
| 4,095,220 | 6/1978 | Sadler | 340/517 |

*Primary Examiner*—Alvin H. Waring

[57] ABSTRACT

A modular alarm system includes a plurality of sensing devices, each of which is adapted to sense the presence or absence of a particular condition, specifically a fire or over heat condition (hereinafter referred to merely as a fire condition), and the presence or absence of a fault including a short circuit or open circuit. The system also includes a detector module for producing an equal plurality of identical logic output signals indicative of and in response to the presence of the particular condition being monitored at the various sensing devices and a single, identical logic output signal indicative of and in response to the presence of a fault at any of the sensing devices. In addition, the system may include a main control module, a relay module and a zone module which functionally interconnect with one another and with the detector module by means of identical logic output signals and which, along with the detector module, preferably include their own power regulators and capacitive filtering systems.

14 Claims, 7 Drawing Figures

MODULAR ALARM SYSTEM

BACKGROUND OF THE INVENTION

The present invention relates generally to alarm systems and more particularly to a modular fire alarm system which is designed to meet a standard catalogue specification but which is easily customized to meet individual needs.

The concept of modulizing alarm systems and particularly fire alarm systems is not new. For example, one such system is illustrated in a Pyrotronics brochure dated February, 1975, entitled "PYR-A-LARM early warning fire detection and alarm system", (Catalog Number 7205). In a later Pyrotronics brochure dated August, 1976 and entitled "General" (Catalog No. 3,000), a "Pyr-A-Larm System 3 Universal Alarm Control System" is generally disclosed.

As stated previously, the present invention is also directed to a modular alarm system, particularly a fire alarm system. However, as will be seen hereinafter, this system is especially designed so as to be economically manufactured in accordance with a standard specification and yet easily and economically modified or customized to meet varying individual needs. As will also be seen, each of the modules in this system includes its own means for isolating it against unwanted noise or other such electrical interference, either from the other modules or from other surrounding equipment.

SUMMARY OF THE INVENTION

One object of the present invention is to provide a modular alarm system which can be economically manufactured in accordance with a standard specification and yet which can be readily modified to meet the specific needs of the individual user.

Another object of the present invention is to provide a modular alarm system including a plurality of modules which differ in function from one another but which may be functionally interconnected by identical logic signals.

Still another object of the present invention is to electrically isolate the input of each of the modules making up the overall system from unwanted electrical noise and other such interference either from the adjacent modules or other such surrounding equipment.

The modular alarm system which carries out the objectives set forth above, as well as other objects and features to become apparent hereinafter, includes a plurality of sensing devices, each of which is provided for distinguishing between the presence or absence of a particular condition, specifically a fire, and also for distinguishing between the presence or absence of a fault in the sensing device, specifically a short circuit or an open circuit. The alarm system also includes at least one module, specifically a detector module, which is provided for producing an equal plurality of identical logic output signals indicative of and in response to the presence of the particular condition being monitored at the sensing devices and a single, identical logic output signal indicative of and in response to the presence of a fault at any of the sensing devices.

In a preferred embodiment, the modular alarm system of the present invention also includes a main control module, a relay module and a zone module, all of which are adapted for interconnection with the detector module and with one another by identical logic output signals for functioning in response thereto. Moreover, in this preferred embodiment, each of the modules making up the overall system including the detector module includes its own power regulator and capacitive filter system for isolating its input from specific unwanted signals including electrical noise and other such interference.

DETAILED DESCRIPTION AND PREFERRED EMBODIMENTS

Figure 1:
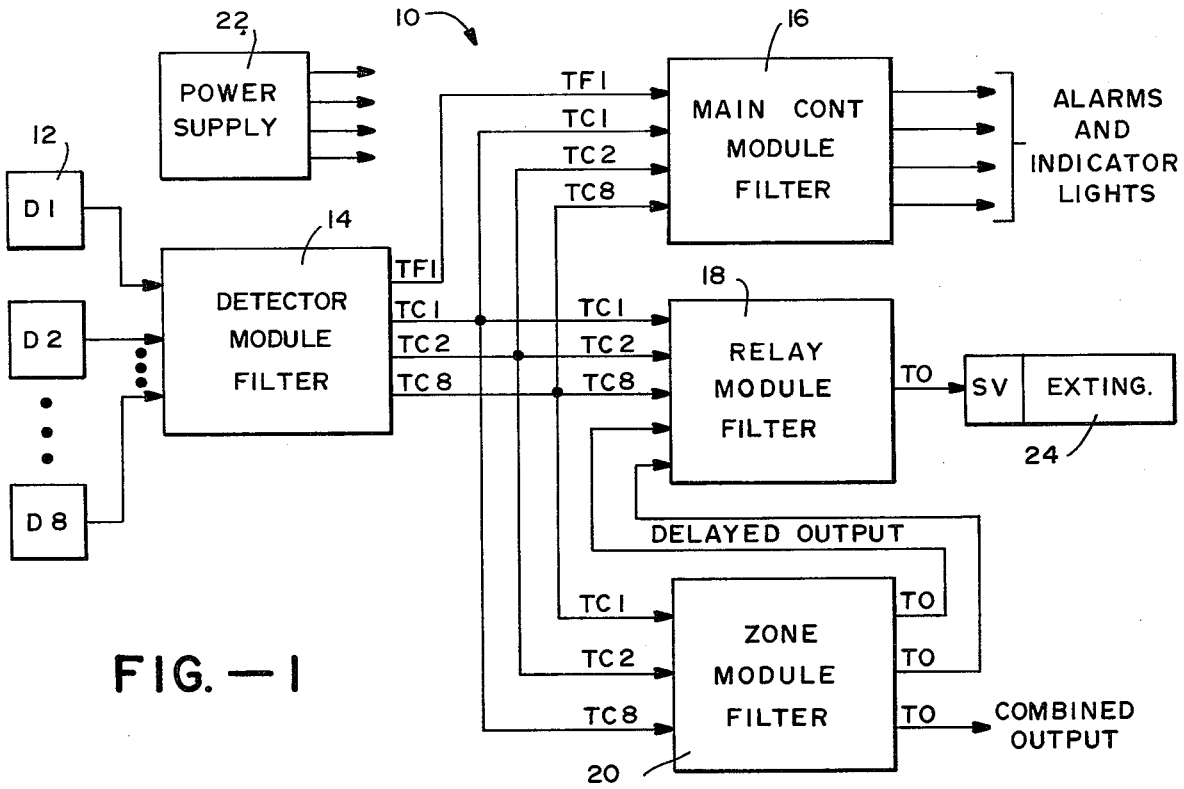
FIG. 1 is a block diagram of an overall modular alarm system constructed in accordance with the present invention.

Turning to the drawings, wherein like components are designated by like reference numerals throughout the various figures, attention is specifically directed to FIG. 1 which illustrates an overall modular alarm system, specifically a fire alarm system, designed in accordance with the present invention, and generally designated by the reference numeral 10. As seen in FIG. 1, overall system 10 includes a plurality of sensing devices or detectors D1, D2 and so on, up to D8, each of which is generally designated at 12. The system also includes a detector module 14 and a plurality of what may be referred to as secondary modules which are different from one another and from the detector module, specifically a main control module 16, a relay module 18 and a zone module 20. This system utilizes main power supply 22 which may operate from 110/220 V AC, 110 V DC, or from a lower voltage emergency battery.

As will be seen hereinafter, each detector 12 is provided for distinguishing between the presence and absence of a particular condition, for example, smoke, fire or a rise in temperature generally, and also for distinguishing between the presence or absence of a fault including a short circuit or open circuit in the detector. All of these detectors are connected to the input of detector module 14 which, as stated previously, produces an equal plurality of identical logic output signals indicative of and in response to the presence of the condition being monitored at the detectors, respectively, and a single identical logic output signal indicative of and in response to the presence of a fault at any of the detectors. These condition indicative logic output signals are respectively applied to the detector module output terminals TC1, TC2 and so on up to TC8 while the single fault indicative output signal is applied to the single terminal TF1, as seen in FIG. 1. As also seen in this figure, the condition indicative terminals TC1, TC2 and so on, are interconnected to corresponding input terminals comprising part of main control module 16, relay module 18 and zone module 20. While the pulse indicative output terminal TF1 is shown interconnected to a corresponding terminal at the output of main control module 16, it may also be connected to the inputs of relay module 18 and zone module 20 for use thereby.

Main control module 16 includes logic circuitry responsive to the logic signals at its inputs for producing signals at its output terminal $T_o$ for driving remote alarms and indicator lights. This circuitry also includes means for producing one or more standard logic output signals at an output terminal TX, which signal may be indicative of and in response to one or more input logic signals for interconnection with and use by the other modules.

Relay module 18 also includes logic circuitry which is responsive to the logic output signals from the detector module or for that matter any logic output signal applied to its input for producing one or more signals at its output terminals $T_o$, one of which is shown, provide for driving external equipment. For example, the drive signal illustrated in FIG. 1 is provided for actuating a solenoid valve comprising part of an overall fire extinguisher 24. Obviously there may be a number of such extinguishers strategically located and responsive to particular detectors.

Finally, as illustrated in FIG. 1, zone module 20 also includes logic circuitry responsive to the logic output signals from the detector module and, again, other logic input signals. As will be seen hereinafter, this logic circuitry performs two specific functions illustrated in FIG. 1. First, it produces logic output signals at output terminals $T_o$ which are delayed by predetermined periods after the initial presence of an input logic signal. In fact, while not shown, one or more delayed output signals may be provided for each input logic signal. These delayed logic signals may be applied to any of the other modules but, in most cases, they will be applied to the input of relay module 18, as indicated in FIG. 1, for actuating one or more fire extinguishers or the like predetermined periods of time after the presence of the particular condition being monitored is detected. The logic circuitry within the zone module is also provided for producing a logic output signal at another output terminal $T_o$ in response to an adjustable combination of input logic signals. Again, while only one such combination output signal is illustrated, it should be apparent that a number of such signals could be provided and it should be equally obvious that these combined output logic signals can be readily applied to the inputs of both the main control module as well as the relay module.

While the various secondary modules, that is, the main control module, the relay module and the zone module, are interconnected to the detector module and to one another by identical logic signals, each module including the detector module is electrically isolated in two ways. First, as will be seen hereinafter, each module includes its own regulator interconnected with the power supply for regulating the power used in driving its own logic circuitry. Second, each module includes a capacitive filter system at its input adapted to prevent signals of less than predetermined duration from reaching its logic circuitry. This is to prevent the individual modules from inadvertently responding to unwanted input signals resulting from noise, cross talk between the modules, as well as other types of electrical interference. Moreover, each module for the most part is comprised of a printed circuit board which, except for its terminal connections is preferably hermetically sealed. Each module including a "circuit card" as it is called slides into and out of an appropriate plug-in type opening in an overall support in a conventional manner for electrical interconnection into the system.

Figure 2:
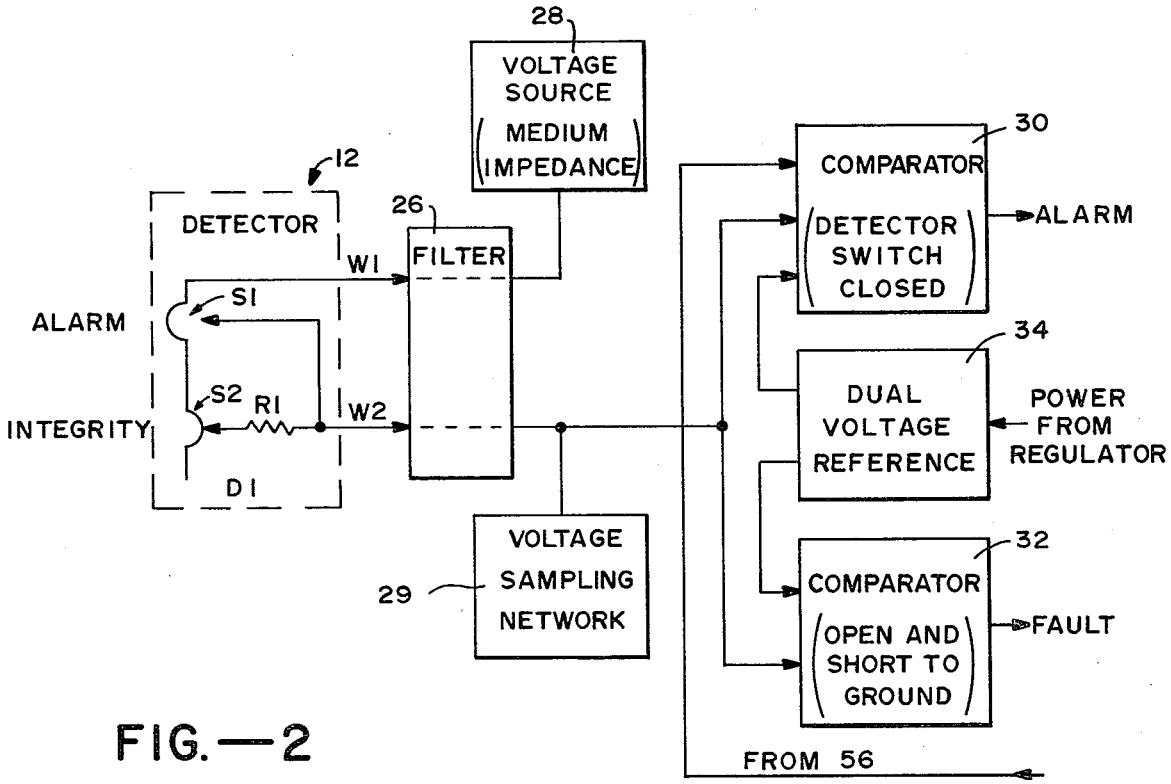
FIG. 2 is a block diagram and partial schematic illustration of a detector or sensing device and one part of a detector module, both of which comprise part of the overall system illustrated in FIG. 1.

Having described system 10 generally, attention is now directed to FIG. 2 for a discussion of one of the detectors 12 and an input stage in detector module 14. As illustrated in FIG. 2, detector 12 is a two wire detector, the wires being indicated at W1 and W2, which operates to close a switch closure S1 in response to the presence of the condition being monitored and to open a switch closure S2 in response to a fault in the detector, including either an open circuit or a closed circuit. The detector may be of any conventional type including, for example, one made available by the Systron-Donner Corporation and described in a 1972 brochure entitled "Fire Protection For Industrial Equipment and Compartments".

The two wires W1 and W2 from each detector 12 go to detector module 14 and particularly to the input of the capacitive filter system 26 which, in and by itself, may be conventional. This filter system, in a preferred embodiment, has a nominal one second time constant (and a range of 0.1 second to 10 seconds) the purpose of which is to reject any noise induced on the input lines, specifically on wires W1 and W2, due to electromotive induction (EMI), radio frequency induction (RFI), motors being turned on and off, and the like.

A voltage source 28, preferably of medium impedance, for example 3,000 ohms, is provided for driving detector 12 with sufficient integrity while, at the same time, providing a sufficiently high impedence so as not to draw excessive current in the event of a short-to-ground in the detector. Located on the opposite side of the detector from source 28 is a voltage sampling network 29 which also comprises part of the detector module and is simply a resistor provided for sampling the current that results from the voltage source passing through a resistor R1 in the detector, which resistor in a preferred embodiment is 8.2 Kohms. In this way, a voltage is developed across the voltage sampling network and is fed to two comparators, an alarm condition responsive comparator 30 and a fault responsive comparator 32. Each of these comparators operates on the voltage developed across the sampling network, as illustrated in FIG. 2, and on a reference voltage generated at a dual voltage reference source 34. More specifically, with regard to comparator 30, if switch closure S1 closes, the voltage across the sampling network rises and crosses over the reference voltage into the comparator for producing a condition indicative alarm signal at its output. On the other hand, if there is either an open circuit or a short to ground in the detector, the voltage across the sampling network drops to a level below the reference voltage supplied to the comparator 72 which produces a fault indicative signal at its output.

For reasons to be discussed hereinafter, comparator 30 may include a third input on the line indicated 36, specifically a test signal provided for simulating the presence of the condition being monitored. As will also be seen, this test signal is initiated at the main control module and is applied not only to the detector module but also to the all of the secondary modules including the main control module itself.

Thus far, the only specific circuit components discussed have been a capacitive filter, the voltage sampling network, two comparators and a voltage reference source along with a detector and its voltage source. As will be seen hereinafter, each of the modules in the overall alarm system includes a number of circuit components including logic circuitry as well as power circuitry. It is to be understood at the outset that these circuit components including the logic circuitry and power circuitry are in and by themselves conventional components which can be readily provided by those in ordinary skill in the art. Hence, a detailed discussion of the electronics making up these components will not be provided herein.

Figure 3:
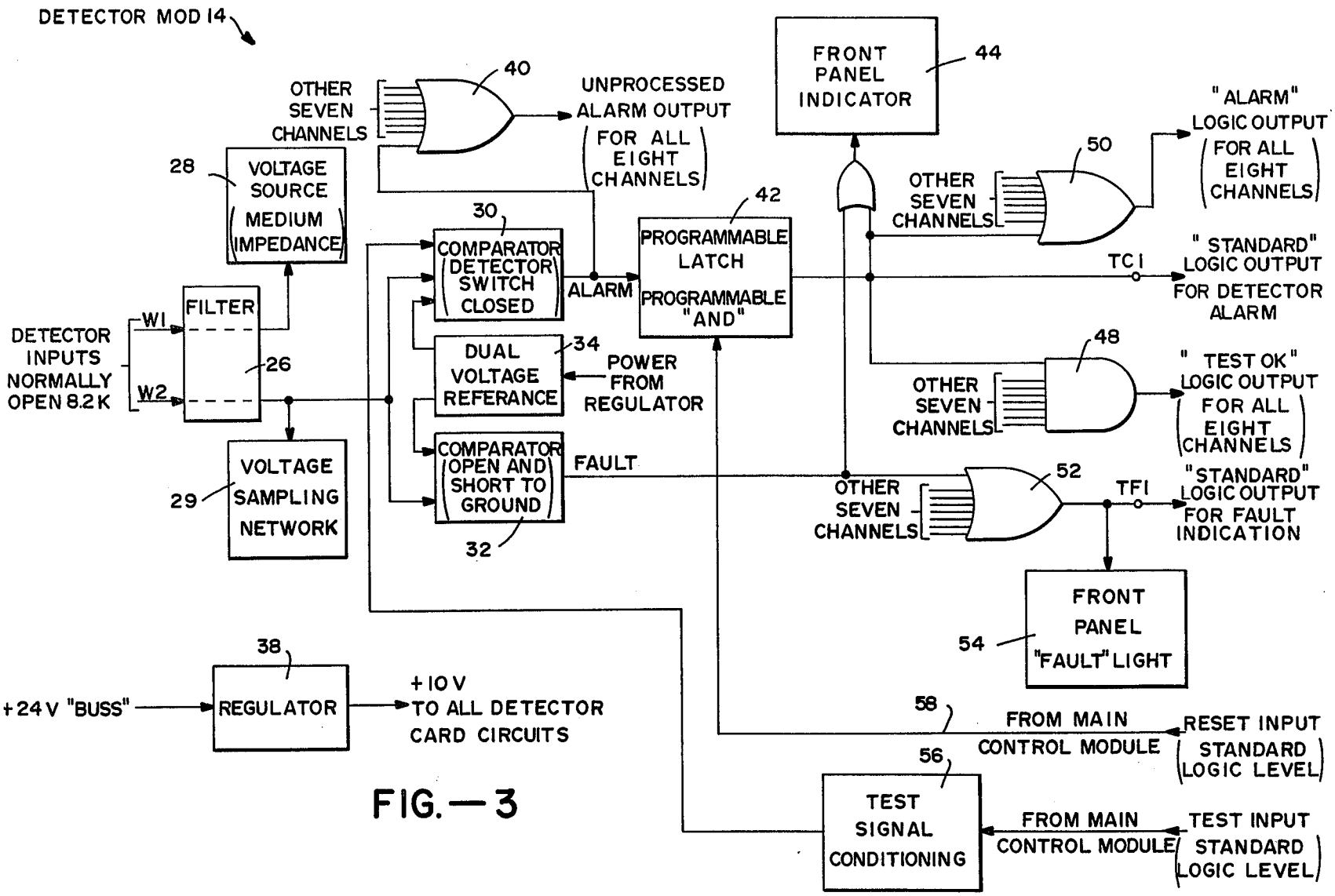
FIG. 3 is a more detailed block diagram of the detector and detector module illustrated in FIG. 2.

Having described detector 12 and an input stage in detector module 14, attention is now directed to FIG. 3 for a more detailed discussion of the detector module. As illustrated in this latter figure, the detector module includes its own voltage regulator 38 which is connected at its input to a 24 volt DC bus which is provided from main control module 16 and which will be discussed hereinafter. The regulator receives 24 volts at its input and regulates it down to 10 volts to be used for powering the logic circuitry within the detector module. This individual regulator provides a very high degree of noise margin to fluctuations in the bus voltage on the line. More specifically, by providing detector module 14 with its own regulator, the susceptability to EMI and noise transients as well as switching and cross talk between modules is minimized if not eliminated as is disturbance due to EMI and switching elsewhere in the system. In addition, the output of regulator 36 supplies the dual voltage reference source 34 discussed with respect to FIG. 2. This is accomplished by dividing the 10 volts down by means of a voltage divider circuit comprising part of circuit 34 (not shown in FIG. 3) to establish an appropriate reference for the alarm comparator and the fault comparator.

Referring now to the logic circuitry comprising part of the detector module, attention is first directed to OR gate 40 which combines all eight alarm channels, that is, all eight of the alarm signals from the eight alarm comparators 30 associated with the eight detectors 12. These signals are combined and taken to the back panel of the module in a single logic line that is labeled "unprocessed alarm output". This output gives a standard logic signal any time there is actuation of any of the eight detectors and may be used, for external purposes. In addition, as illustrated in FIG. 3, each of these individual alarm output signals, that is, the output signal from each individual alarm comparator, goes to its own programmable latch and circuit 42 including a series of jumpers which can either be installed or deleted in order to have latching capabilities, ANDing capability, or straight through signalling. In this regard, circuit 42 includes AND gate circuitry and also a conventional memory circuit for placing its input signal in memory and producing an output signal at a later time, thereby "latching in" an input signal.

The output at the programmable latch 42 is a standard alarm indicative logic output signal for the given detector in the detector module, that is, it is the signal which is produced at the output terminal TC1 or TC2 and so on, referred to in FIG. 1. However, this signal after leaving the latch circuit also goes to three other places. First, it goes to a front indicator panel 44 through an OR gate 46 indicating that that particular channel has been an alarm condition. It also goes to an AND gate 48 where it is combined with the other seven channels, that is, the corresponding signals from the other seven channels, to provide a "test" okay output signal under test conditions which will be discussed hereinafter with respect to main control module 16. For the moment, it suffices to state that a test signal is intentionally introduced into each module including the detector module under test conditions and specifically to all eight channels so as to simultaneously check all of these channels. Finally, the output signal from latch circuit 42 is applied to another OR gate 50 which combines all of the channels in the same manner and for the same reasons as previously recited OR gate 40. However, the logic output from OR gate 50 is an output signal after latching has taken place through the programmable latch circuit. If the latch is not programmed to be used, then the alarm logic output, that is, the signals at the output of OR gate 50, and the unprocessed alarm output at gate 40 produce the same signal at the same time.

Detector module 14 includes nine indicator lights, one each for the alarm or condition indicative inputs (for the eight detectors) indicated at 44 and one indicating a circuit fault in any of the detectors indicated at 54. The eight alarm indicator lights are appropriately labelled in accordance with the particular channel they represent and the particular way the associated detector is used. For example, if detector D1 is provided for protecting a pump room, its associated indicator light on the front of the detector module will be labelled "pump room". That indicator light is the one which is controlled by the output of programmable latch circuit 42 through OR gate 46 as stated previously. The corresponding fault indicating light 54 will be discussed below.

As illustrated in FIG. 3, the output from the fault comparator 32 is applied to an OR gate 52 where it is combined with the other seven channels to give a single output which is the standard fault indicating logic output signal produced at the output terminal TF1 as discussed with respect to FIG. 1. As stated with respect to FIG. 1, this standard logic output signal is applied to a corresponding input signal TF1 in the main control module where, as will be seen hereinafter, it is provided for activating a fault light. In addition, this signal is applied to indicator light 54 on the front panel of the detector module, specifically the ninth indicator light referred to above. This particular indicator light is labelled "circuit fault". However, when this light comes on, it only indicates that there is a fault in one of the eight detectors and does not indicate in which detector the fault resides. However, as seen in FIG. 3, the output of each fault comparator 32 is also connected to the input of OR gate 46. In this way, should there be a fault condition in a particular detector, not only will fault indicator light 54 come on but also the alarm indicator light 44 associated with the particular channel. In this way, the channel displaying the fault is readily indicated on the front panel of the detector module.

The final component in the detector module illustrated in FIG. 3 is a conditioning circuit 56 which is provided in line 36 previously described with respect to FIG. 2. Circuit 56 takes a standard logic input signal which is developed as a test signal from the main control panel and conditions it so as to simulate an alarm condition referred to previously. More specifically, circuit 56 converts the standard logic signal to the proper voltage and current levels, specifically to that produced when the switch closure S1 closes, so as to simulate an alarm condition. Finally, as seen in FIG. 3, there is an input line 58 which is adapted for connection to the main control panel for resetting programmable latch 42.

Figure 4:
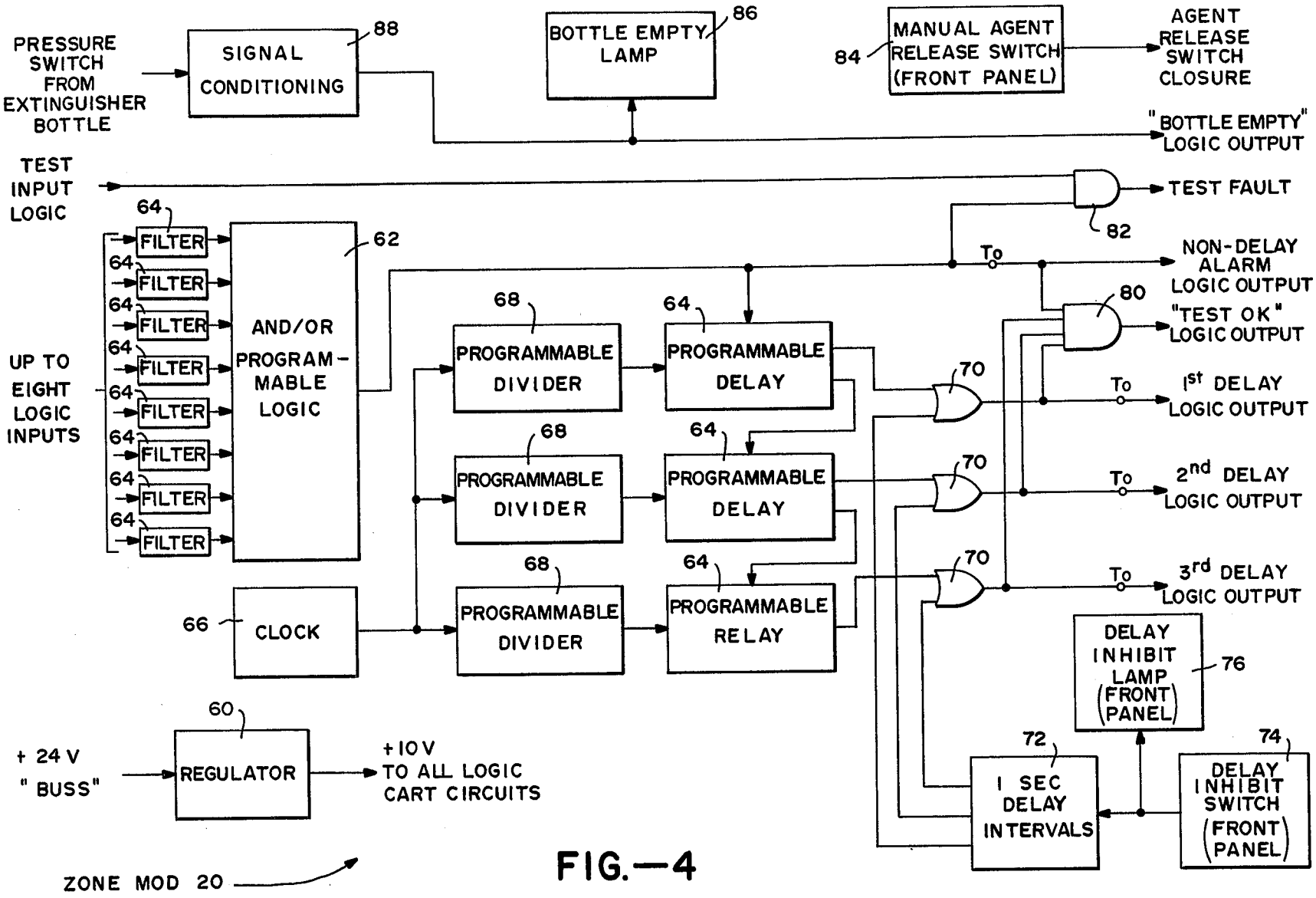
FIG. 4 is a detailed block diagram of a zone module comprising part of the overall system illustrated in FIG. 1.

Having described detector module 14 in detail, attention is now directed to FIG. 4 for a detailed discussion of zone module 20. At the outset, it should be noted that this module also includes its own regulator 60 which may be identical to previously recited regulator 38 and which, like regulator 38, is connected to the common 24 volt bus from the main control module for producing its own 10 volt supply. This 10 volt supply is provided for operating the various logic circuitry which comprises part of the zone module and which will be discussed below.

As stated previously zone module 20 is provided for performing two primary functions, one of which is to program the logic output signals from the detector module and the other of which is to provide a delay in these signals. The first of these functions is accomplished by means of a combination AND/OR programmable logic circuit 62 which is adapted to receive a standard logic output signal from each programmable latch 42 and, hence, eight in all, each representing a different channel. Note however that all of these signals are subjected to a capacitive filter system 64 which may be similar to previously recited capacitive filter 26. However, where capacitive filter 26 has a nominal time constant of one second and operates within a range of 0.1 second and 10 seconds, capacitive filter 64 preferably has a time constant of approximately 20 milliseconds and an overall range of between 1 millisecond and 1 second. This filter primarily serves to suppress EMI and RFI.

After the logic input signals pass through filtering system 64, they enter the programmable logic circuit 62, as stated above. This circuit is a programmable circuit because it utilizes a series of jumpers inside the module to allow the operator to program his own AND/OR combination (and/combinations) so as to produce a single representative output signal which is the "combined output" applied to one of the terminals $T_o$ discussed with respect to FIG. 1. As a result, should the operator wish to provide an output only when, for example, channels 1, 3 AND 5 respond to the presence of a condition, or possibly when channels 1 AND 3 OR 5 respond to the presence of that condition, this can be accomplished utilizing programmable circuit 62. The ultimately produced output signal can be applied to the input of the main control module, or it can be used to drive various relays in the relay module, as will also be seen.

The programmed output signal from programmable circuit 62 is simultaneously supplied to a set of three programmable delays 64. These programmable delays are driven by a clock 66 which produces a high frequency clock signal supplied to three programmable dividers 68, each of which provides a clock output to an associated delay. By utilizing these dividers, the operator can select particular increments of time for each of the programmable delays. The clock serves to fire each delay in sequential, programmed time intervals. More specifically, the overall alarm system may, for example, require sequential firing of a series of fire extinguishers for releasing extinguishant from a series of bottles with time intervals varying between the releases. Clock 66 provides the time base for determining what these intervals will be. The programmable dividers are a further refinement of that time base and determine the granularity of the time increments selected. Obviously, the finer the increment of time, the less the total selected time can be. Hence, if the operator wants a very long time delay, he should select second increments out of the programmable divider and time delays on the order of minutes out of the programmable delay. In any event, once the overall delay program is set, sequential delayed output signals are produced at the output of the programmable delays in response to the programmed logic output signal from programmable logic circuit 62 and are applied through OR gates 70 and to the previously recited output terminals $T_o$, of Of course, after programmed sequential delays.

Each OR gate 70 is provided as an override or bypass to the overall delay program. More specifically, zone module 20 includes a fixed programmable delay circuit 72 providing a fixed delay between its input and outputs, specifically a one second delay in the embodiment illustrated. This circuit is connected at its input to the output of a delay inhibit switch 74 which when actuated overrides the program from delays 64 and dividers 68 to automatically provide fixed intervals between the presence of the signal from logic circuit 62 and the production of output signals at terminals $T_o$, specifically one second intervals in the embodiment illustrated. This override system is desirable if, for example, it is necessary to actuate a group of extinguishers quickly rather than in the slower preprogrammed way. In this regard, a delay inhibit or override indicator light 76 is connected in line with the delay switch 74 and is energized when the switch is actuated for indicating this override condition. This indicator light is located on the front panel of the zone module.

Associated with each of the four outputs thus far discussed, that is, the three outputs from OR gates 70 and the single output directly from logic circuit 62, is an AND gate 80 and an AND gate 82. AND gate 80 provides a single output when all four of the outputs just mentioned are activated. This combined output signal which appears at another output terminal of the zone module is provided for indicating the various components are in working order under a test condition. This combined output signal would normally be applied to the main control module for activating an indicator light showing that the test was successful. AND gate 82 is also provided for test purposes. Specifically, this AND gate combines a logic input test signal with the logic output signal from programmable logic circuit 62. The output from AND gate 82 which is applied to an appropriate output terminal on zone module 20 for connection to an indicator light in the main control panel indicates a fault situation if there has been a test commanded and there is no resulting signal at the output of the programmable logic circuit 62.

In addition to the various components just described, zone module 20 includes a manual agent release switch 84 which is located on the front panel and which is provided to bypass all of the functions of the modular system and go directly to a secondary or backup release system to activate particular extinguishers manually. In addition to this manual agent release switch, the zone module includes an indicator light 86 on its front panel which is connected to a signal conditioning circuit 88. The signal conditioning circuit and indicator light are connected to appropriate input terminals which in turn may be connected to appropriate pressure monitors at the extinguishers so as to energize the indicator light 86 in the event that the pressure which is within the particular extinguishers falls below a certain value. This, of course, would include the situation where the extinguishers were empty. The signal conditioning circuit may simultaneously provide a logic output signal to an appropriate terminal on the zone module which in turn may be applied to an appropriate indicator light or horn at the main control module or other remote locations.

Figure 5:
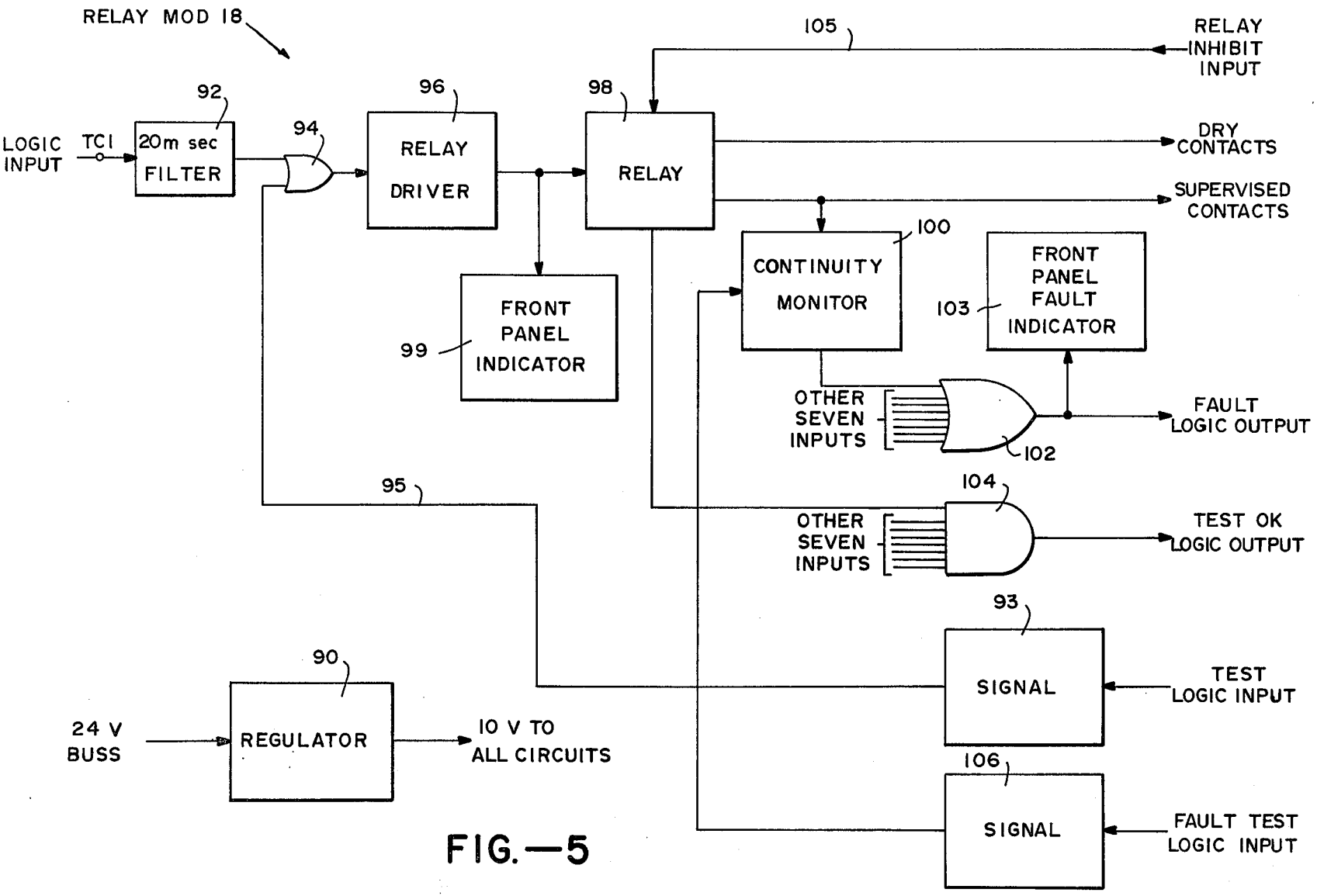
FIG. 5 is a detailed block diagram of a relay module comprising part of the overall system illustrated in FIG. 1.

Having described zone module 20 in detail, attention is now directed to the relay module 18 which is illustrated in FIG. 5. Turning to this figure, it can be seen at the outset that the relay module includes a regulator 90 which may be identical to previously recited regulator 60 in the zone module and which, like regular 60, is connected to the common 24 volt bus discussed previously. The output of regulator 90 provides 10 volts to the logic circuitry in the relay module to be discussed below. The relay module also includes a capacitive filter 92 which is located at its input and which may be identical to previously described capacitive filter 64. In actuality, each input terminal receiving a standard input logic signal includes a capacitive filter 92. Obviously, these filters and the regulator 90 provide the same isolation advantages for the relay module as discussed previously with respect to the detector module and zone module.

As indicated in FIG. 5, each logic input signal, whether it comes from the detector module or the zone module passes through an associated filter 92 and into an OR gate 94 which combines this signal with a test signal from the main control panel via lead 95. In this regard, the line carrying the test logic signal into OR gate 94 includes a test signal conditioning circuit 93 which functions in the same way as circuit 56. The output from OR gate 94 is applied to a relay driver 96 which may simply be a transistor amplifier to supply current to the coils of an electromagnetic relay 98. In this regard, while not shown, the power to drive the relay is from a 24 volt supply distinct from the common bus discussed previously. In this way, the separate power supply can be deactivated under inhibit or test conditions. The reason for this is to insure that there is no voltage available to the relay coil under either of these conditions so that an extinguisher or other such apparatus cannot be activated inadvertently, as will be seen. An indicator lamp 99 located on the front panel of the relay module is electrically connected between the relay driver and the relay to indicate whether or not the relay has been energized.

Relay 98 normally supplies two outputs, the first of which is a set of dry contacts supplied to an appropriate output terminal (not shown) and to be used, for example, for engine shutdown or the like. The second set of contacts, referred to as supervised contacts, are supplied to the output terminal $T_0$ and are used to supply all 24 volts to the using device, for example, for energizing a solenoid valve comprising part of fire extinguisher 24 for actuating the latter. These supervised contacts can also be used to supply an extremely low current to the using device and back to the zone module through the continuity monitor 100 in order to watch for continuity in the line between the relay and the using device. In this way, if the solenoid valve on the fire extinguisher of the using device generally is connected in a way which or otherwise displays an open circuit, this will be indicated on the continuity monitor. This monitor in actuality is a comparator which looks at the voltage across a diode in the return line to see if indeed there is a continuous path. The output of this continuity monitor along with the output of the other continuity monitors in the various channels of the relay module go through an OR gate 102 and the combined output signal is applied first to an appropriate indicator light 103 on the front panel of the relay module and second to an output terminal on the relay module where it can be applied to an external point, for example to the main control module.

As stated above, relay 98 includes dry contacts and supervised contacts. It also includes an output which goes to an AND gate 104 along with corresponding outputs from other relays in the various other channels. This AND gate supervises the test condition for the relays. More specifically, when the test switch is activated (to be discussed with respect to the main control module) a test is in process. At that time, a signal is supplied from the main control module to the relay along the relay inhibit line 105 for inhibiting operation of the relay which would normally energize in response to a signal at its input. Further, under this test condition, even though there is a signal at its input, as a result of the test signal supplied to the OR gate 94 via lead 95, the relay does not energize. Rather, a signal is applied from its test indicating output to AND gate 104, as stated above. However, it should be noted that this signal is provided through the coil of the relay 98 for testing the integrity of that coil. The output of AND gate 104 is used in the same manner as other test outputs, specifically to activate appropriate test indicating lights to show the satisfactory test has been accomplished.

Finally, relay module 18 includes a second test signal conditioner circuit 106 which is adapted to condition a fault testing input logic signal and apply it to the continuity monitor for simulating a fault and making sure that all of the supervisory circuits function properly. This test fault logic input signal, like the other test signals, is applied from the main control panel to be discussed below and produces a simulated output signal at the output of monitor 100.

Figure 6:
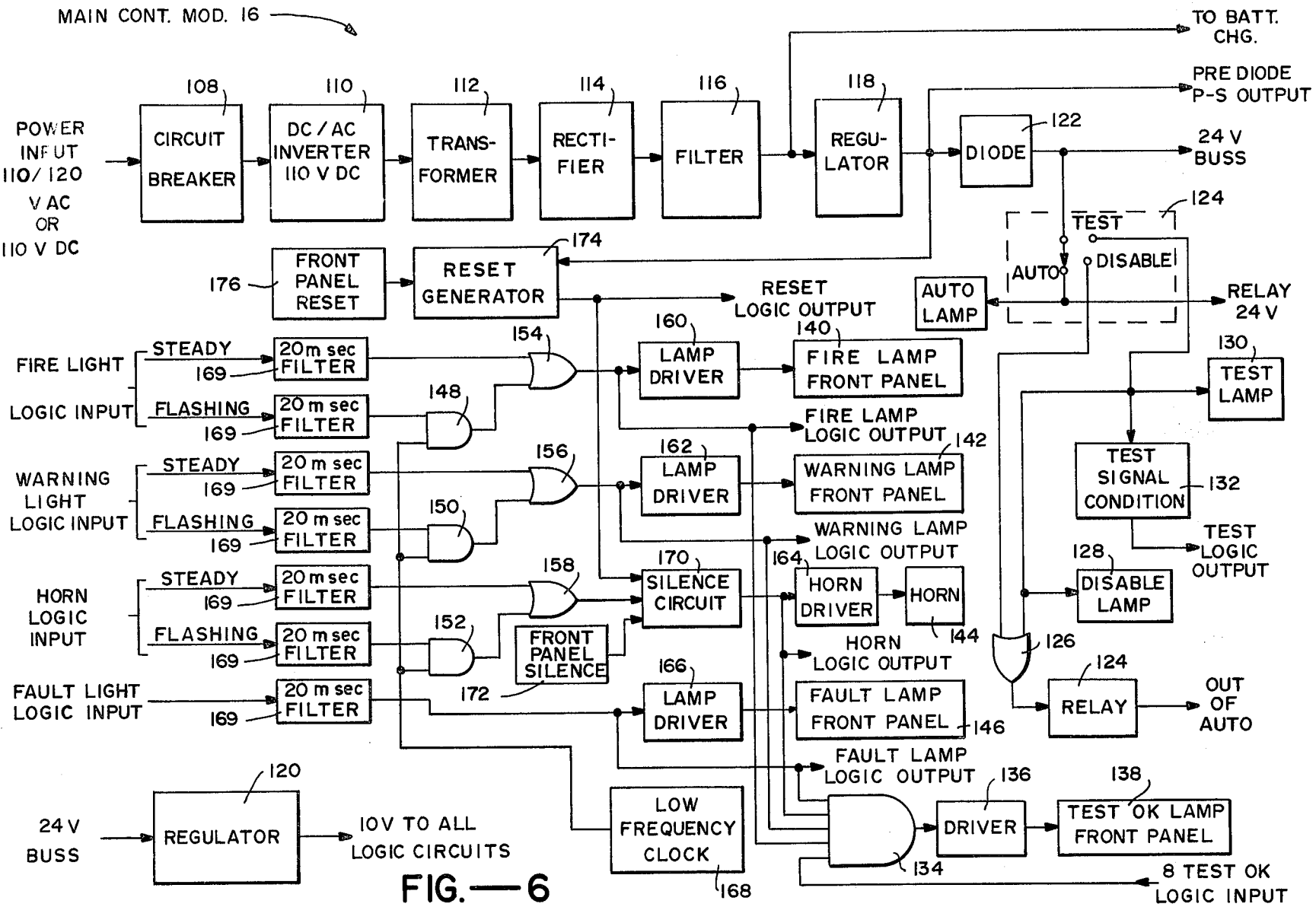
FIG. 6 is a detailed block diagram of a power supply or main control module comprising part of the overall system illustrated in FIG. 1.

Turning now to FIG. 6, attention is specifically directed to the main control module or the power supply module as it may also be called. In either case, this particular module will be used in most if not all installations whereas it is quite possible that the zone module and/or the relay module may be omitted. Starting at the upper left hand corner in FIG. 6, it can be seen that this module is adapted to receive 110/220 V AC power or 110 V DC power. In either case, the zone module includes a circuit breaker 108, the purpose of which is self explanatory. The input power goes through the breaker and into a DC/AC invertor 110 which would be used with 110 V DC input power. Obviously, this inverter would not be necessary where the input is 110/220 V AC power. In any event, AC power whether provided originally or produced at the output of the inverter is provided for driving a transformer 112 which is provided for transforming the voltage down to about 35–40 volts and which supplies this reduced voltage to a rectifier 114. The output of rectifier 114 is connected to the input of a conventional filter capacitor 116 which in turn is connected to the input of a regulator 118 designed to supply the previously recited common 24 volt bus. With regard to the common bus, it should be noted that this bus supplies 4 amps of current at 24 volts and feeds into all of the regulators discussed previously as well as individual regulator 120 comprising part of the main control module itself. This latter regulator may be identical to the previously discussed regulators for providing 10 volts to the logic circuitry comprising part of the main control module.

As indicated in FIG. 6, the output of filter 116 is also applied through an appropriate output terminal to a battery module to be discussed in detail hereinafter with respect to FIG. 7. For the moment, it suffices to say that this output which, as stated, is on the order of 35 to 40 volts is used to provide charging current to the battery module. The reason that a preregulated output is used here, that is, an output ahead of the regulator, is that the battery in the battery module supplies 24 volts and, hence, it is desirable to have a significantly higher voltage in order to charge the battery from what approximates a current source.

Returning to regulator 118, it can be seen that this regulator includes three outputs. One of these outputs is labeled "Pre-diode power supply output" and is applied to the battery module (to be discussed) at a point between the regulator and a diode 122 connected to its output. Its purpose is to provide a line for the battery module to monitor for determining whether or not there is a loss of power at the input of the power supply module. More specifically, when the main power supply is interrupted, the battery module takes over for supplying 24 volts to the common bus. The reason that the battery module monitors the main power supply at a point ahead of diode 122 is to prevent the battery module from supervising itself. More specifically, if the battery module supervised the power circuit after the diode, once the battery module takes over it would see its own output on the 24 volt bus and would never know if the power supply had come back on line. By placing it before the diode, it cannot monitor itself. A second output from regulator 118 is applied through the diode and into the 24 volt common bus discussed previously.

A third output, actually an output through the diode, is applied to and through a selector switch 124. As stated previously, the various relays in relay module 18 are supplied with 24 volts from a supply other than the common bus. This supply is provided from the output of diode 122 through selector switch 124 when the latter is in its "auto" position. On the other hand, when the selector switch is in its disabled and test positions illustrated in FIG. 6, an open circuit is provided between the output of diode 122 and the coils of the relay and, hence, no power is supplied to the coils of the relays, thereby making it impossible to inadvertently activate the extinguishers or other such external apparatus. In actuality, this is accomplished by driving a relay 124 in the power supply module through an OR gate 126 when the selector switch is in either its disabled position or its test position. More specifically, in either of these positions relay 124 is energized which, in turn, opens appropriate contacts in circuit with the relays in the relay module. Note also that these signals out of the switch are provided for activating a disable lamp 128 and a test lamp 130 which are located on the front panel of the main control module.

With the selector switch specifically in its test position, it can be seen from FIG. 6 that a signal is not only applied to relay 124 and to test lamp 130 but also through a test signal conditioning circuit 132 and out of the module. It is this standard logic signal which is applied to the various other modules for test purposes, as discussed previously. Once this testing program is initiated, the entire system responds as if all of the channels sense a condition or a fault, with the exception of the relays in the relay module. As stated above, the relays themselves are disabled but are operated to produce simulated outputs, as also discussed previously. All of these test outputs which originally appear in the power supply module are applied to AND gate 134 for producing a combined signal which is applied to a driver 136 for energizing a "test okay" lamp 138 on the front panel of the main control module. Note that this AND gate also includes the eight logic input signals from detector module 14.

In addition to regulating and controlling the power, main control module 16 serves a number of other functions. More specifically, as illustrated in FIG. 6, this module includes a fire lamp 140, a warning lamp 142, a horn 144 and a fault lamp 146, all of which, possibly with the exception of the horn, would most likely be located on the front panel of the main control module. The horn might be located just above the module or at a remote location.

As illustrated in FIG. 6, main control module 16 includes AND gates 148, 150 and 152, OR gates 154, 156 and 158, and drivers 160, 162, 164, and 166. AND gate 148 combines the standard logic input signal from detector module 14 or for that matter from the other modules, with a low frequency clock signal from clock circuit 168 and provides a pulsate output signal which is applied to OR gate 154. The OR gate in turn drives the lamp driver 160 in a pulsating manner for driving the fire lamp in a "flashing" mode. Note however that a second standard logic input signal is applied to the OR gate 154 for application of a steady signal to the lamp driver for energizing the fire light in a "continuous" mode. The warning lamp and horn may be driven in either the "flashing" or the "continuous" mode in a similar manner. However, a circuit 170 is provided between OR gate 158 and horn driver 164 for de-energizing the horn after it has been energized. This may be accomplished by utilizing a selector switch 172 located on the front panel of the main control module or by means of a reset generator 174 which is provided not only for resetting the horn but the entire system. In this regard, it will be noted that the reset generator not only includes a reset switch 176 on the front panel but it also is initiated by the output from regulator 118 in the event that power is lost and then comes back on line. As indicated in FIG. 6, the fault light 146 does not include the option of a flashing mode, but merely responds to a standard logic output supplied directly to the lamp driver 166. As illustrated in FIG. 6, each logic input in the main control module includes a capacitive filter system 169 which may be identical to previously discussed filters 92.

Figure 7:
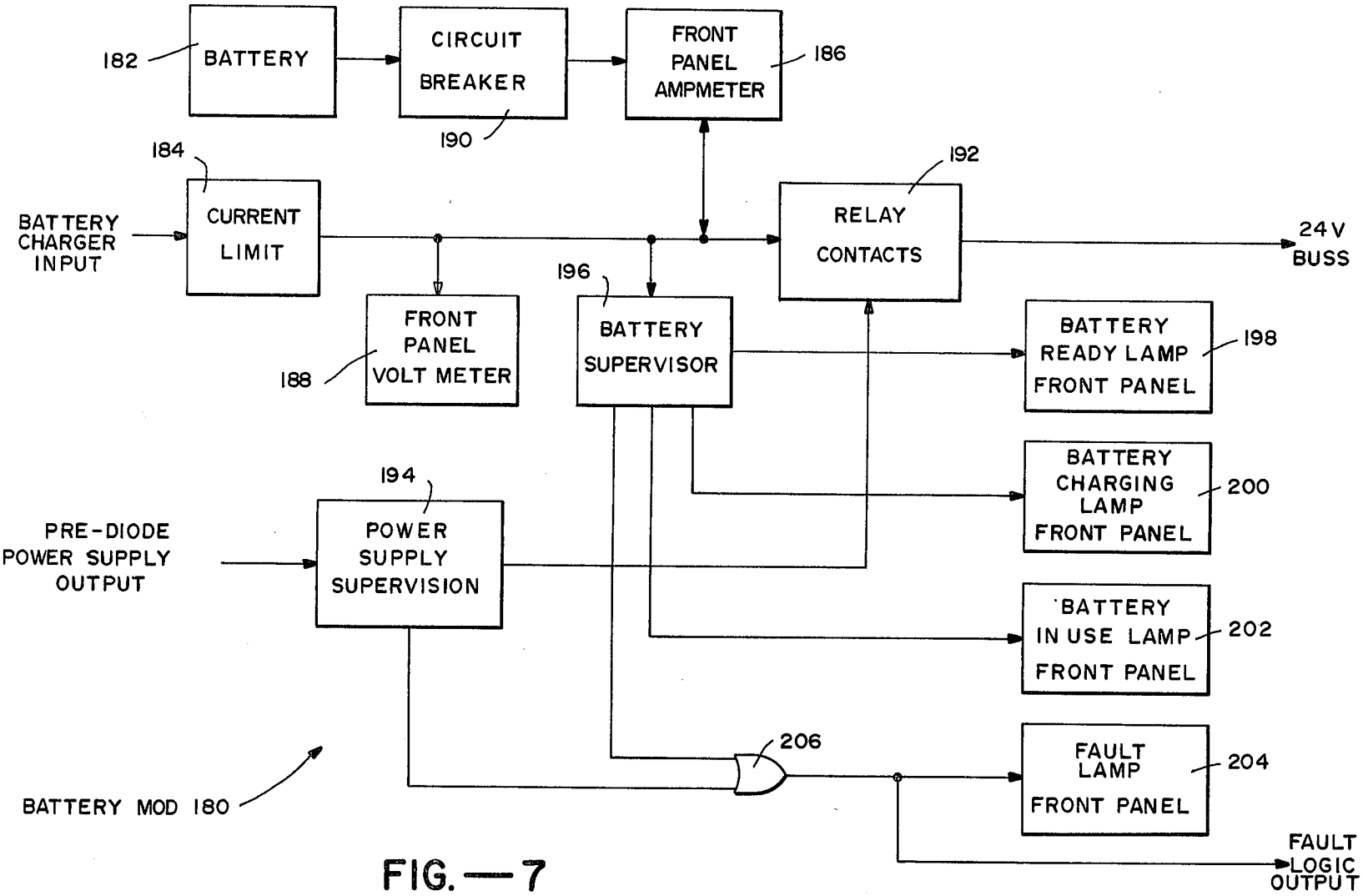
FIG. 7 is a detailed block diagram of a battery module which may also comprise part of the overall system illustrated in FIG. 1.

Having described main control module 30, attention is now directed to an additional module, specifically a battery module 180 which is illustrated in FIG. 7. The overall system may or may not include this particular module which includes as its basic component a battery 182, specifically a nickel cadmium battery having a 2 amp/hour capability. As stated previously with respect to FIG. 6, a 35 to 40 volt input is applied to the battery module, specifically through current limiting circuit 184 which is provided for maintaining the charging current at a fixed, relatively low level, specifically at a 0.1 ampere/hour rate. This charging current is applied through an ammeter 186 which may be located on the front panel of the battery module and also to a voltmeter 188 which may be located next to the ammeter. A charging current is supplied to the battery through the ammeter, a circuit breaker 190 and also through a set of relay contacts of a relay 192 from the output of filter 116 (see FIG. 6). The relay is driven by a power supply supervisory circuit 194 which monitors the pre-diode supply discussed with respect to the main control module in FIG. 6 for supervising the 24 volt common bus from the power supply. In the event that the pre-diode voltage drops off as a result of the main power supply being interrupted, the supervisory circuit will activate relay 192 and will bring the battery in line.

The battery module also includes a battery supervisory circuit 196 which provides several functions. In the first place, it monitors the condition of the battery and serves to drive a series of front panel indicators, specifically a "battery ready" lamp 198, a "battery charging" lamp 200, a "battery in use" lamp 202 and, in part, a "fault" lamp 204. Lamp 198, that is, the "battery ready" lamp, comes on when the battery supervisory circuit sees sufficient voltage to know that the battery is up to full charge. The "battery charging" lamp 200 is activated any time the battery is being charged and the "battery in use" lamp indicates that the battery is being used. The "fault" lamp is used to indicate when the battery is low on voltage and yet is being asked to supply on line signals or to supply the 24 volt bus. In this regard, an OR gate 206 is utilized to combine the outputs from the battery supervisory circuit 196 and the power supply supervisory circuit 194. It will be noted that the output from this OR gate not only goes to lamp 204 but also to a fault logic output signal which is taken back to the main control module to activate a fault light there.

What is claimed is:

1. A modulized alarm system, comprising:

(a) a plurality of sensing devices, each of which includes means for distinguishing between the presence or absence of a particular condition;

(b) a detector module connected at its input to said sensing devices and having means including logic circuitry for producing an equal plurality of identical logit output signals indicative of and in response to the presence of said condition at said sensing devices, respectively, and filter means for preventing signals of predetermined maximum duration at its input from reaching its logic circuitry;

(c) a plurality of modules different from one another and from said detector module, each of said different modules being adapted for interconnection at its input with said detector modules and the other different modules by logic output signals identical in kind to said logic output signals, each of said different modules having means including logic circuitry responsive to a logic output signal at its input for performing at least one particular function distinct from the other different modules and filter means for preventing signals of predetermined maximum duration at its input from reaching its logic circuitry; and (d) means for powering said sensing devices and said modules including individual power regulating means associated with and connected to each of said modules for regulating power from said powering means to the logic circuitry of said associated module.

2. A modulized alarm system, comprising:

(a) a plurality of sensing devices, each of which includes (i) first means operable between two states for distinguishing between the presence and absence of a particular condition, and (ii) second means operable between two states for distinguishing between the presence and absence of a fault in said sensing device, including a short to ground or an open-circuit;

(b) a detector module including (i) an equal plurality of condition sensing output terminals respectively associated with said sensing devices and a single fault sensing output terminal associated with all of said devices, (ii) an equal plurality of means respectively cooperating with said plurality of condition distinguishing first means and respectively connected to said condition sensing terminals for producing a logic output signal at said condition sensing terminals indicative of and in response to the presence of said condition at associated sensing devices, and (iii) an equal plurality of second means cooperating with all of said fault distinguishing second means and connected to said fault sensing terminal for producing an identical logic output signal at said fault sensing terminal indicative of and in response to the presence of a fault at any of said sensing devices; and (c) means for powering said sending devices with said detector module.

3. A modulized alarm system, comprising:

(a) a plurality of sensing devices, each of which includes (i) first means for distinguishing between the presence or absence of a particular condition and (ii) second means for distinguishing between the presence or absence of a fault including a short to ground or open circuit in said sensing device;

(b) a detector module connected at its input to said sensing device and including (i) means for producing an equal plurality of identical logic output signals indicative of and in response to the presence of said condition at said sensing devices, respectively, and (ii) means for producing a single logic output signal, identical to said plurality of logic output signals, in response to the presence of a fault at any of said sensing devices;

(c) a plurality of modules different from one another and from said detector module, each of said different modules being adapted for interconnection at its input with said detector modules and the other different modules by logic output signals identical in kind to said logic output signals and being responsive to a logic output signal at its input for performing at least one particular function distinct from the other different modules; and (d) means for powering said sensing devices and said modules.

4. A system according to claim 3 wherein each of said modules includes logic circuitry and individual means connected with said powering means for regulating the power to this logic circuitry.

5. A system according to claim 4 wherein each of said modules includes its own capacitive filter means for preventing electrical signals of predetermined maximum duration at its input from reaching its logic circuitry.

6. A system according to claim 3 wherein said different modules include a main control module having at least one output terminal and including means for producing at said terminal an alarm driving power signal adapted to drive an external alarm in response to the presence of said logit output signals.

7. A system according to claim 3 wherein said different modules includes a switch module having at least one output terminal and control means including at least one switch operable between an on or off state, said control means actuating said switch in response to the presence of said logic output signal for producing a signal at said last-mentioned output terminal for driving an external apparatus.

8. A system according to claim 7 wherein said switch is an electromagnetic relay including a coil and at least one contact, said apparatus driving signal being applied through one of said contacts.

9. A system according to claim 8 including means for applying a logic signal indicative of a test condition at the input of said relay coil whereby to energize the latter and means for disabling said driving signals during application of said test signal even though such coil is energized.

10. A system according to claim 3 wherein said different modules includes a zone module having at least one output terminal and including circuit delay means for producing an identical logic output signal at said one output terminal in response to but an adjustably fixed period of time after the initial presence of said logic output signal.

11. A system according to claim 10 wherein said circuit delay means includes by-pass means for producing said delayed logic output signal at said last-mentioned terminal a pre-set period of time after the initial presence of said logic output signal, said preset period of time being different than said adjustably fixed period of time.

12. A system according to claim 3 wherein said different modules include a zone module having an output terminal and including means for producing an identical output signal at said last-mentioned output terminal in response to the presence of a predetermined adjustable combination of said logic output signals.

13. A system according to claim 3 wherein each of said first means includes latching means having a memory circuit for maintaining said condition indicating logic output signal in said memory circuit after said last mentioned output signal has been produced and means for producing said memory maintained logic output signal at an associated output terminal at a later time.

14. A modulized alarm system, comprising:

(a) power supply means;

(b) a plurality of sensing devices, each of which includes (i) first means operable between two states for distinguishing between the presence and absence of a particular condition, and (ii) second means operable between two states for distinguishing between the presence and absence of a fault in said sensing device, including a short to ground or an open-circuit (c) a detector module including (i) an equal plurality of condition sensing output terminals respectively associated with said sensing devices and a single fault sensing output terminal associated with all of said devices (ii) means including logic circuitry respectively cooperating with said plurality of condition distinguishing first means and respectively connected to said condition sensing terminals for producing a logic output signal at said condition sensing terminals indicative of and in response to the presence of said condition at associated sensing devices (iii) an equal plurality of second means cooperating with all of said fault distinguishing second means and connected to said fault sensing terminal for producing an identical logic output signal at said fault sensing terminal indicative of and in response to the presence of a fault at any of said sensing devices, (iv) capacitive filter means adapted for connection with each of said sensing devices and connected with an associated cooperating means for preventing electrical signals of at most 0.1 to 10 second duration at said associated sensing device from reaching said cooperating means, and (v) means adapted for connection with said power supply means and connected with all of said cooperating means for regulating the power to the logic circuitry of each cooperating means;

(d) a main control module including (i) at least one output terminal, (ii) means including logic circuitry for producing at said main control output terminal an alarm driving power signal adapted to drive an external alarm in response to the presence of said logic output signal at its input, (iii) capacitive filter means at its input for preventing electrical signals of at most 0.001 to 1 second duration at said input from reaching its logic circuitry, and (iv) means adapted for connection with said power supply means for regulating the power to its logic circuitry (e) a relay module having at least one output terminal and including (i) control means including logic circuitry and at least one electromagnetic relay including a coil and contacts operable between an energized state and a de-energized state, said control means energizing said relay coil in response to the presence of said logic output signal at its input for producing a signal through at least one of said contacts for driving an external apparatus (ii) capacitive filter means at said last-mentioned input for preventing electrical signals of at most 0.001 to 1 second duration at said last mentioned input from reaching said last-mentioned circuitry, and (iii) means adapted for connection with said power supply means for regulating the power to the last-mentioned logic circuitry; and (f) a zone module having at least two output terminals and including (i) signal combining means including logic circuitry for producing an identical output signal at said one of said last-mentioned output terminals in response to the presence of a predetermined adjustable combination of logic output sitnals (ii) delay means including logic circuitry for producing an identical logic output signal at the other of said last-mentioned output terminals in response to but an adjustably fixed period of time after the initial presence of said logic output signal (iii) capacitive filter means adapted for preventing electrical signals of at most 0.001 to 1 second duration at the inputs of said signal combining means and said delay means from reaching the logic circuitry of each of said last-mentioned means, and (iv) means adapted for connection with said power supply means and connected with said signal combining means and said delay means for regulating the power to the logic circuitry of each of said last-mentioned means.

* * * * *